US008810473B2

(12) United States Patent
Fruh

(10) Patent No.: US 8,810,473 B2
(45) Date of Patent: Aug. 19, 2014

(54) NON-PENETRATING MOUNTING SYSTEM FOR ANTENNA

(75) Inventor: Jason Fruh, Castle Rock, CO (US)

(73) Assignee: EchoStar Technologies L.L.C., Englewood, CO (US)

( * ) Notice: Subject to any disclaimer, the term of this patent is extended or adjusted under 35 U.S.C. 154(b) by 494 days.

(21) Appl. No.: 13/300,439

(22) Filed: Nov. 18, 2011

(65) Prior Publication Data

US 2013/0127686 A1 May 23, 2013

(51) Int. Cl.
*H01Q 1/12* (2006.01)
*H01Q 19/12* (2006.01)
*H01Q 1/18* (2006.01)

(52) U.S. Cl.
CPC ..... *H01Q 1/1207* (2013.01); *H01Q 19/12* (2013.01); *H01Q 1/18* (2013.01)
USPC ..... 343/887; 343/719; 343/878; 343/890

(58) Field of Classification Search
CPC ..... H01Q 1/1207; H01Q 1/18; H01Q 19/12
USPC ..... 343/719, 878, 887, 880, 890
See application file for complete search history.

(56) References Cited

U.S. PATENT DOCUMENTS

| | | | | |
|---|---|---|---|---|
| 4,318,076 | A * | 3/1982 | Whitfield | 340/947 |
| 4,649,675 | A | 3/1987 | Moldovan et al. | |
| 4,922,264 | A | 5/1990 | Fitzgerald et al. | |
| 5,027,539 | A * | 7/1991 | Orsini | 40/415 |
| 5,142,293 | A | 8/1992 | Ross | |
| 5,760,751 | A | 6/1998 | Gipson | |
| 6,798,387 | B2 | 9/2004 | Cockell et al. | |
| 2006/0236910 | A1 * | 10/2006 | Boucher et al. | 114/90 |

* cited by examiner

*Primary Examiner* — Dieu H Duong
(74) *Attorney, Agent, or Firm* — Seed IP Law Group PLLC

(57) ABSTRACT

A non-penetrating antenna mounting system is provided. The system includes a frame, an antenna, and an airfoil. The frame is configured to retain ballast to secure the frame to a surface of a structure without penetrating the surface of the structure. The antenna is mounted on the frame. The airfoil is mounted on the frame and is oriented relative to the frame to impart a downforce on the frame when exposed to wind. The airfoil can be rotatably mounted on the frame. The system can also include a wind vane mounted to the airfoil, with the wind vane and the airfoil being configured to turn into the wind.

20 Claims, 9 Drawing Sheets

NON-PENETRATING MOUNTING SYSTEM FOR ANTENNA

BACKGROUND

1. Technical Field

The present disclosure generally relates to a mounting system for antennas that does not require fasteners extending into the building on which it is mounted, and, more particularly, to a non-penetrating antenna mounting system that includes an airfoil.

2. Description of the Related Art

Satellite dish antennas are commonly used in television receiving systems. A satellite dish antenna often has a dish-shaped receiver that collects and focuses incoming transmissions transmitted by a satellite. A parabolic surface of the dish-shaped receiver can reflect the transmissions to a waveguide, such as a feedhorn. Satellite dish antennas can be mounted on roofs, walls, residential structures, commercial buildings, or the like.

Many commercial buildings and multi-dwelling units, such as apartment buildings, have restrictions on how a satellite dish antenna can be mounted to the building structure. For example, there are typically restrictions that prohibit satellite dish antenna mounting devices from penetrating the structure. To bypass these restrictions, many satellite dish antenna systems are mounted to a non-penetrating base, which does not require any holes to be made in the underlying structure in order to secure the antenna. The non-penetrating base is then loaded with ballast to supply adequate weight to keep the base from moving in a strong wind. Known types of ballast used in such devices include, but are not limited to, cinder blocks, bricks, sand, and water.

BRIEF SUMMARY

In one embodiment of the present disclosure, a non-penetrating antenna mounting system includes an airfoil which improves the stability of a satellite dish antenna mounting system that is exposed to high wind speeds. The airfoil is mounted, either directly or indirectly, to a non-penetrating base configured to support ballast. The airfoil can be configured to rotate relative to the base so as to automatically orient itself with respect to the current wind direction. In another embodiment, the airfoil is fixed relative to the non-penetrating base.

A non-penetrating antenna mounting system that includes an airfoil can increase stability without increasing the amount of ballast required. As explained in greater detail below, when the airfoil is exposed to wind, the shape and orientation of the airfoil creates a differential in air pressure between the area above the airfoil and the area below the airfoil. This pressure differential generates a downforce on the antenna mounting system. As a result, the antenna mounting system becomes more securely anchored to the structure without requiring the underlying structure to be penetrated, and without requiring any additional ballast.

In another embodiment, a non-penetrating antenna mounting system includes a frame, an antenna, and an airfoil. The frame is configured to retain ballast to secure the frame to a surface of a structure without penetrating the surface of the structure. The antenna is mounted on the frame. The airfoil is mounted on the frame and is oriented relative to the frame to impart a downforce on the frame when exposed to wind. The airfoil in this embodiment can be rotatably mounted on the frame. The non-penetrating antenna mounting system can also include a wind vane mounted to the airfoil, with the wind vane and the airfoil being configured to turn into the wind.

In another embodiment, an antenna mounting system includes a base, an antenna, an airfoil, and a wind vane. The antenna is mounted to the base. The airfoil is rotatably mounted to the base. The airfoil includes a profile configured to impart a downward force to the base when the airfoil faces into a current wind direction. The wind vane is fixedly mounted to the airfoil. The wind vane is configured to rotate the wind vane and the airfoil into the current wind direction.

In another embodiment, a method for securing an antenna to a structure without penetrating the structure is provided. The method includes mounting a base to an external surface of a structure without penetrating the surface of the structure, mounting an antenna to the base, and arranging an airfoil on the base. The arranging the airfoil includes orienting the airfoil so that the airfoil will be exposed to wind, orienting the airfoil so that the airfoil will impart a downward force on the base when facing into the wind, mounting a wind vane to the airfoil so that the wind vane is fixed relative to the airfoil, and mounting the airfoil and the wind vane to the base so that the wind vane to the airfoil are rotatable relative to the base, the wind vane driving rotation of the airfoil when exposed to the wind so that the airfoil and the wind vane face into the wind.

DETAILED DESCRIPTION

I. System Overview

Satellite dish antennas can be highly directional antennas that are aimed at a desired broadcasting satellite in order to properly receive a transmission. It is preferable to maintain a clear line of sight between the satellite dish antenna and the satellite. As such, satellite dish antennas are typically mounted in areas that are at risk for exposure to high winds, such as the top of tall buildings. These high winds can make it difficult for a satellite dish antenna system mounted on a non-penetrating base to maintain a proper orientation for collecting incoming transmissions from a satellite.

For a satellite dish antenna mounted using a non-penetrating base, high winds can be particularly problematic. For example, when cinder blocks are used as ballast in a non-penetrating base, increasing the number of blocks in order to prevent movement of the satellite dish antenna at higher wind speeds can increase the height of the block stack, thereby contributing to the drag force on the entire satellite dish antenna system. In addition, increasing the number of blocks increases the cost of the system, has the potential to damage the roof structure, and can increase the amount of work required for an installer.

Figure 1A:
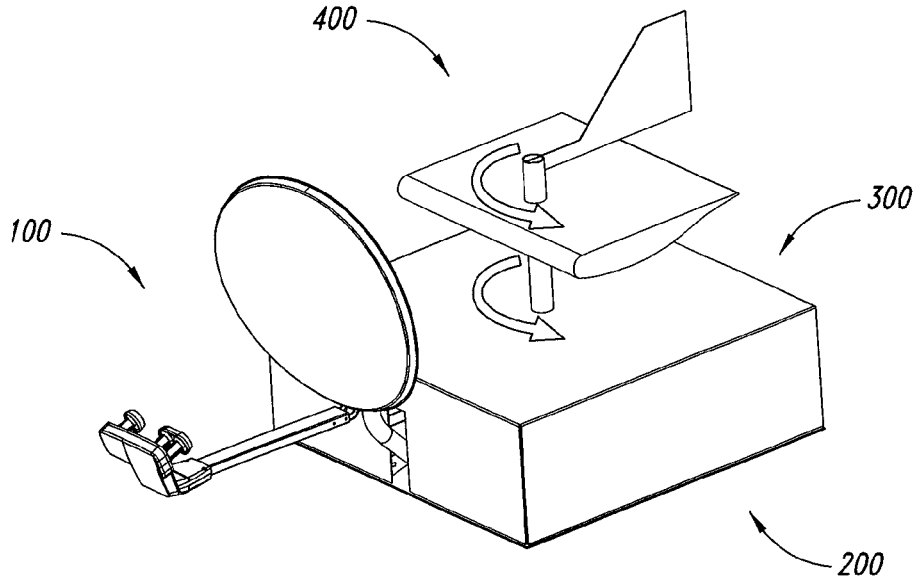
FIG. 1A is a isometric view of a non-penetrating antenna mounting system according to one embodiment of the present disclosure.
Figure 1B:
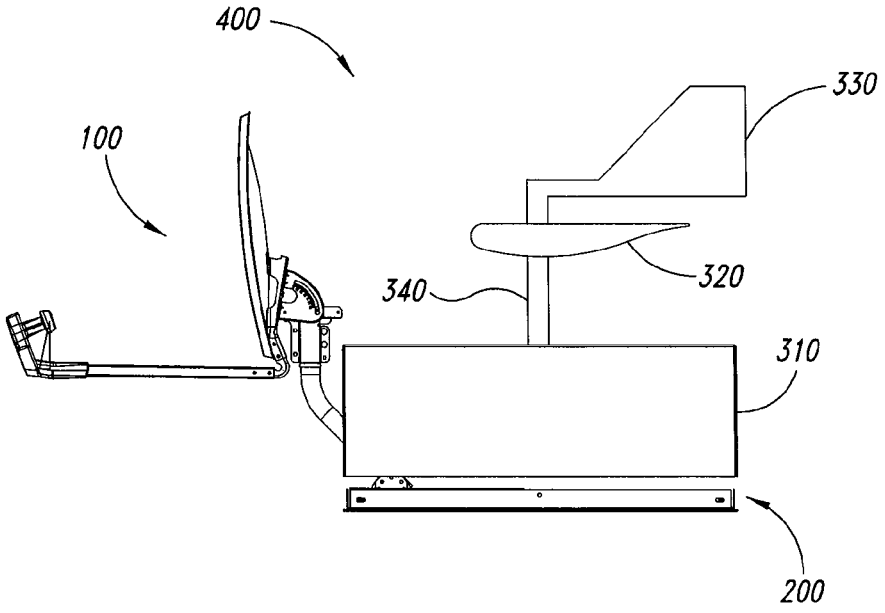
FIG. 1B is a side view of the non-penetrating antenna mounting system shown in FIG. 1A, with an example airfoil mount assembly illustrated slightly offset above an example non-penetrating base.

FIGS. 1A and 1B illustrate an example non-penetrating antenna mounting system 400 that improves the stability of a satellite dish antenna mounting system that is exposed to high wind speeds without requiring the underlying structure to be penetrated, and without requiring any additional ballast. The non-penetrating antenna mounting system 400 includes an antenna system 100 assembled with a non-penetrating base 200 and an airfoil mount assembly 300. In the context of the present disclosure, the term "airfoil" is defined as a structure having a shape and orientation that allows the structure to control stability, direction, lift, and/or downforce of another object to which it is mounted. In the embodiment illustrated in FIGS. 1A and 1B, the airfoil mount assembly includes an airfoil 320 that is rotatable together with a wind vane 330 so as to automatically orient the airfoil 320 relative to the current wind direction.

FIG. 1B is a side view of the non-penetrating antenna mounting system shown in FIG. 1A. The antenna system 100 is assembled to the non-penetrating base 200. The non-penetrating base 200 is a frame structure configured to retain ballast, such as, for example, cinder blocks. For ease of representation, the airfoil mount assembly 300 in FIG. 1B is illustrated slightly offset above the non-penetrating base 200, and the ballast is not depicted. As will be readily apparent to those having ordinary skill in the art, other known types of ballast, such as bricks, sand, or water, can be used instead of cinder blocks without deviating from the scope of the present disclosure.

In the example shown in FIGS. 1A and 1B, the airfoil mount assembly 300 includes a support structure 310, an airfoil 320, a wind vane 330, and a support shaft 340. As discussed in greater detail below, the support structure 310 fits over the non-penetrating base 200 and the ballast secured therein; and the wind vane 330 acts together with the support shaft 340 to point the air foil 320 into the wind flow for any given wind direction.

II. Hardware

Figure 2A:
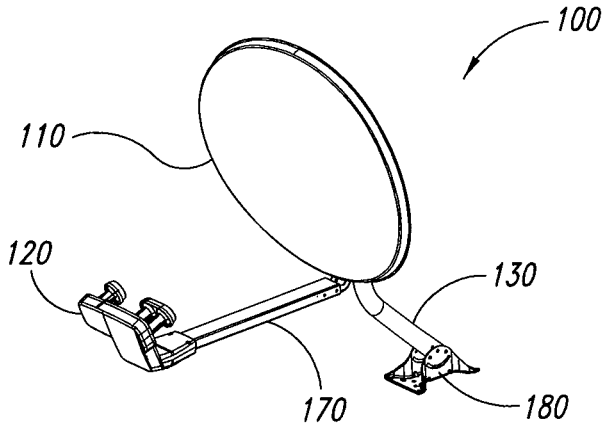
FIG. 2A is a isometric view of an antenna system according to one embodiment of the present disclosure.
Figure 2B:
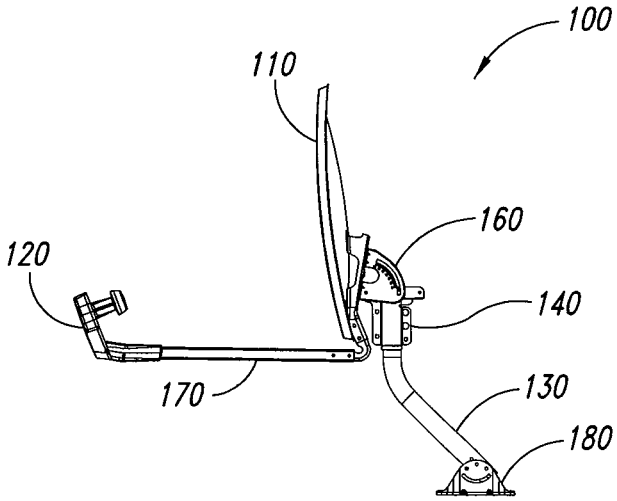
FIG. 2B is a side view of the antenna system shown in FIG. 2A.

FIGS. 2A and 2B illustrate an antenna system 100 according to one embodiment of the present disclosure. The antenna system 100 includes a dish 110 and a signal feed portion 120, positioned to communicate with the dish 110. The antenna system 100 is supported by a mast 130 that extends from an anchoring bracket 180 to a mast mounting portion 140. A positioning mechanism 160 is adapted to adjust the azimuth angle of the dish 110. A user can operate the adjustment mechanism 160 to controllably rotate the dish 110 with respect to the mast 130.

The dish 110 is configured to transmit signals to and/or receive signals from one or more communication systems, such as one or more satellites. The dish 110 can be a circular or oval parabolic dish that reflects signals from a source and focuses the signals towards the signal feed portion 120. The size, shape, and configuration of the dish 110 can be selected based on the type of signals to be received, position of the signal sources, configuration of the signal feed portion 120, or the like.

An arm 170 extends outwardly away from the dish 110 and supports the signal feed portion 120. The signal feed portion 120 collects signals from the dish 110 and delivers those signals to a processing system of the antenna system 100. The processing system can include, without limitation, one or more processing units, converters, amplifiers, adapters, feed devices, or the like. Converters can be low-noise block down converters. The amplifiers can be low-noise amplifiers. The processing units can include, without limitation, a low-noise block down converter, adaptors, or the like.

Figure 3A:
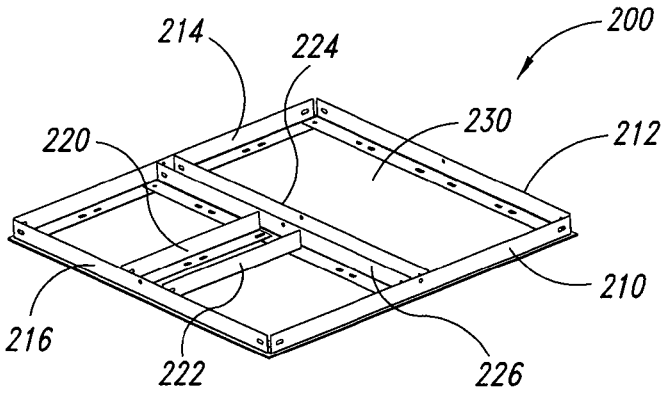
FIG. 3A is a isometric view of a non-penetrating base according to one embodiment of the present disclosure.
Figure 3B:
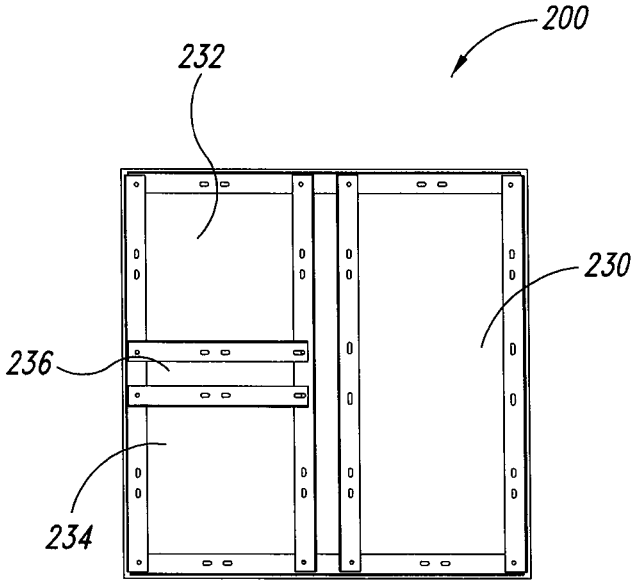
FIG. 3B is a plan view of the non-penetrating base shown in FIG. 3A.

FIGS. 3A and 3B illustrate a non-penetrating base according to one embodiment of the present disclosure. The non-penetrating base 200 is a frame configured to be mounted on a structure without damaging or penetrating a surface of the structure. For example, the non-penetrating base 200 can be placed on the roof of an apartment complex without requiring any holes be drilled into the roof. The non-penetrating base 200 is secured to the roof, at least in part, by way of ballast placed within the non-penetrating base 200.

The non-penetrating base 200 includes a bottom wall 230. Sidewalls 210, 212, 214, and 216 extend vertically upwards from the bottom wall 230. The sidewalls 210, 212, 214, and 216 include through holes that enable the non-penetrating base to be secured to the airfoil mount assembly 300, as will be discussed in greater detail below. In addition, the sidewalls can assist with the placement and retention of ballast, such as cinder blocks, and can also add to the overall strength and rigidity of the non-penetrating base 200.

In this example, the non-penetrating base 200 also includes interior walls 220, 222, 224, and 226 extending vertically upwards from the bottom wall 230. The interior walls can contribute to the stability of the non-penetrating base 200. The interior walls can also define separate areas within the non-penetrating base 200 for ballast and for an antenna. For example, area 232 is delineated by the bottom wall 230, a portion of sidewall 214, a portion of sidewall 216, interior wall 220, and a portion of interior wall 226. Likewise, area 234 is delineated by the bottom wall 230, a portion of sidewall 216, a portion of sidewall 210, interior wall 222, and a portion of interior wall 226. Area 236 is delineated by the bottom wall 230, a portion of sidewall 216, interior wall 220, interior wall 222, and a portion of interior wall 226. Areas 232 and 234 can be reserved for ballast, and area 236 can be reserved for securing an antenna to the non-penetrating base 200.

As will be readily apparent to one having ordinary skill in the art, the configuration of the sidewalls and the internal walls of the non-penetrating base 200 can be modified so as to accommodate any desired type of ballast or other types of antennas without deviating from the scope of the present disclosure.

Figure 4A:
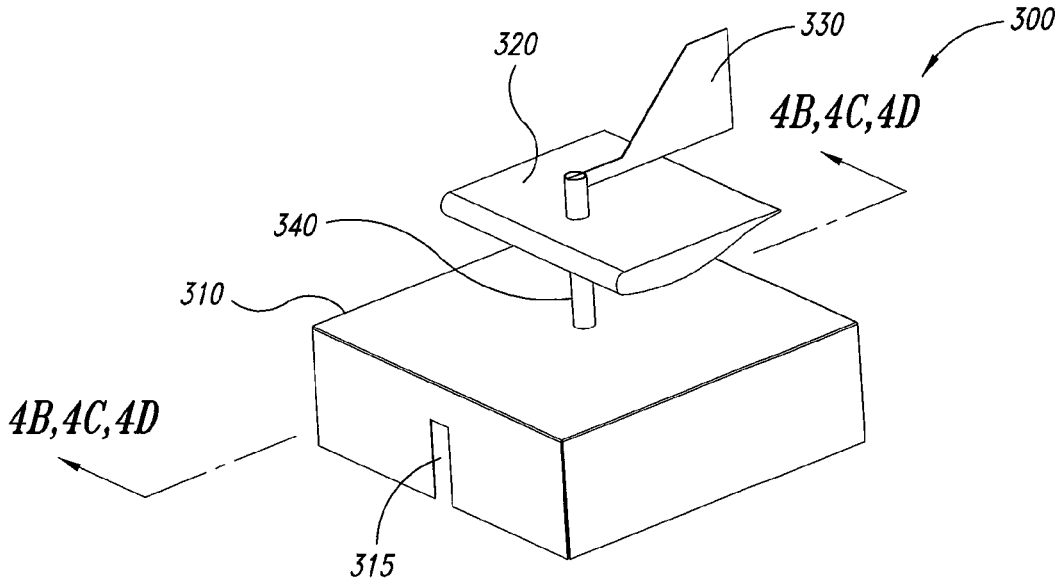
FIG. 4A is a isometric view of an airfoil mounting assembly according to one embodiment of the present disclosure.
Figure 4B:
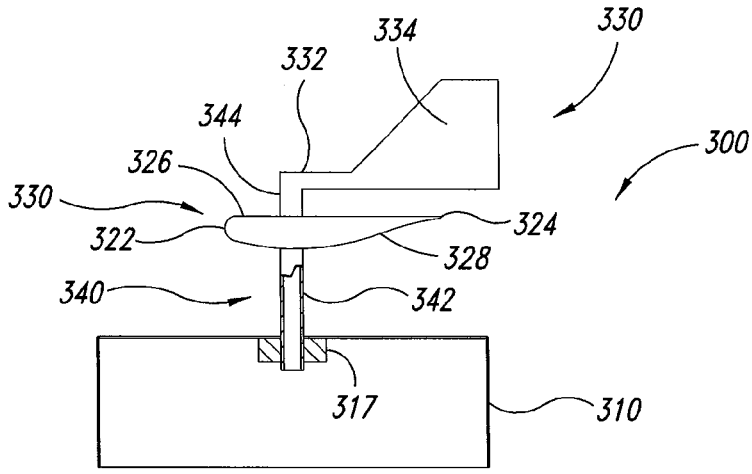
FIG. 4B is a partially cut-away side view of the airfoil mounting assembly shown in FIG. 4A.

FIGS. 4A and 4B illustrate an airfoil mounting assembly according to one embodiment of the present disclosure. The airfoil mount assembly 300 includes a support structure 310, an airfoil 320, a wind vane 330, and a support shaft 340.

The support structure 310 includes an opening 315 sized and shaped to accommodate an antenna mast without interfering with the operation of the airfoil mount assembly 300 or the antenna. In operation, the support structure 310 can serve several different functions. For example, the support structure 310 can completely conceal and protect the ballast material from the elements. The support structure 310 can also provide a secure enclosure for the ballast, thereby helping to ensure that ballast is not removed by individuals seeking to steal the antenna. The support structure 310 also supports the structure associated with the airfoil 320, the wind vane 330, and the support shaft 340. The size and shape of the support structure 310 also serves to more evenly distribute load transmitted from the airfoil to the non-penetrating base 200.

A support shaft 340 extends vertically upwards from the support structure 310. The support shaft 340 includes a lower shaft portion 342 and an upper shaft portion 344. The airfoil 320 is supported between the lower shaft portion 342 and an upper shaft portion 344. The airfoil has a shape similar to an airplane wing turned upside down. The airfoil extends from a leading edge 322 to a trailing edge 324.

The wind vane 330 is supported by the upper shaft portion 344. As best shown in FIG. 4B, the lower shaft portion 342 is secured within a bearing 317 mounted on the support structure 310. The bearing 317 allows the support shaft 340 to freely rotate relative to the support structure 310 about a vertical axis of the support shaft 340. The bearing 317 can be a journal bearing, an independent bushing, a ball bearing, or any other suitable bearing. The airfoil 320 and the wind vane 330 are fixed relative to the support shaft 340. Thus, the airfoil 320, the wind vane 330, and the support shaft 340 are able to swivel relative to the support structure 310 as a unit.

The wind vane 330 drives the rotation of the support shaft 340 to properly orient the airfoil 320 relative to the current wind direction. The wind vane 330 has a long, narrow body that extends from a lead portion 332 to a tail portion 334. The lead portion 332 connects the wind vane 330 to the upper shaft 344. The tail portion 334 has a larger surface area that acts like the vane in a weather vane. As wind strikes the broad side surfaces of the tail portion 334, the wind vane 330 swivels into the wind until the narrow width of the body of the wind vane 330 is directed into the wind. As the wind vane 330 is fixed relative to the airfoil 320, the airfoil 320 swivels together with the wind vane 330, resulting in the lead portion 322 of the airfoil being oriented into the wind.

In another embodiment, the upper shaft portion 344 can be eliminated, and the wind vane is secured directly to the lower shaft portion 342.

Figure 4C:
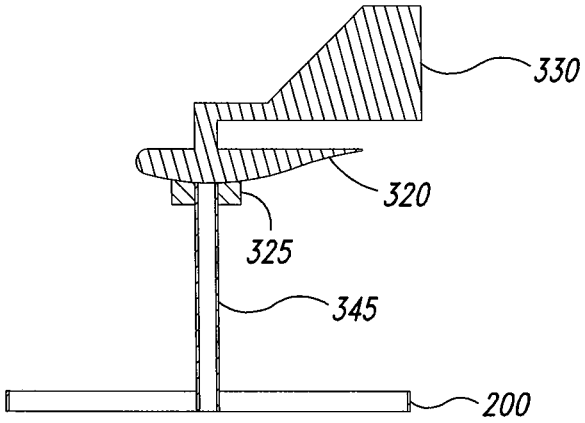
FIG. 4C is a cut-away side view of an airfoil mounting assembly according to another embodiment.

FIG. 4C shows another embodiment in which the airfoil 320 and the wind vane 330 are formed as a single, unitary piece. In this embodiment, a shaft 345 is fixedly secured directly to the base 200. The airfoil 320 and the wind vane 330 are secured to the shaft 345 via a bearing 325 which allows the airfoil 320 and the wind vane 330 to rotate together as a unit relative to the shaft 345.

Figure 4D:
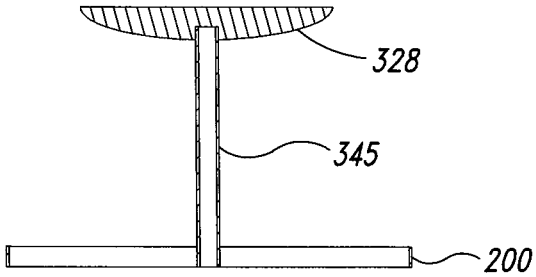
FIG. 4D is a cut-away side view of an airfoil mounting assembly according to another embodiment.

FIG. 4D shows another embodiment in which an airfoil 328 is fixedly mounted to the base via the shaft 345 in a manner that does not allow for any rotation of the airfoil 328 relative to the base 200. The airfoil mounting assembly in this embodiment does not include a wind vane 330. Instead, the airfoil 328 has a symmetrical, saucer shape that allows it to impart a downward force on the base 200 regardless of wind direction. An upper surface of the airfoil 328 is substantially flat, and a lower surface of the airfoil 328 includes a curve that is symmetrical with respect to a vertical axis of the airfoil 328.

In another embodiment, the airfoil 328 in FIG. 4D is replaced with an airfoil 320, having the shape shown in FIG. 4B, that is fixedly mounted to the shaft 345. The shaft 345 could also be replaced with the support structure 310. The airfoil mounting assembly in this embodiment may or may not include a wind vane 330. The orientation (including the angle of attack) of the airfoil 320 can be selected prior to installation, during fabrication of the airfoil mounting assembly. As an alternative, the orientation of the airfoil could be set when the airfoil mounting assembly is assembled to the non-penetrating mount base at the worksite. The airfoil 320 could also be mounted to the shaft 345, or the support structure 310, in a manner that allows for orientation of the airfoil 320 relative to the shaft 345 or the support structure 310 to be adjusted at a later time by using any of a variety of mounting techniques that will be immediately appreciated by an individual of ordinary skill in the art who has reviewed this entire disclosure.

Further, although the figures depicts a support structure 310 which covers the ballast, it is also within the scope of the present disclosure to use other types of support structure that do not enclose the ballast. For example, it is also within the scope of the present disclosure to utilize a support structure that merely extends over a portion of ballast, but nevertheless serves to transfer downforce from the airfoil 320 to the ballast or directly to the non-penetrating mount 200. Such a structure could also be, configured to support the support shaft 340 and the wind vane 330, if applicable.

Figure 5B:
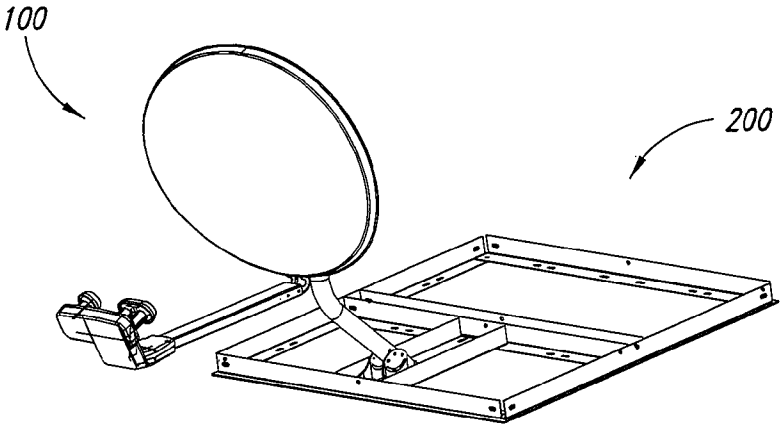
FIGS. 5A and 5B illustrate an antenna system being mounted to a non-penetrating base according to one embodiment of the present disclosure.
Figure 5A:
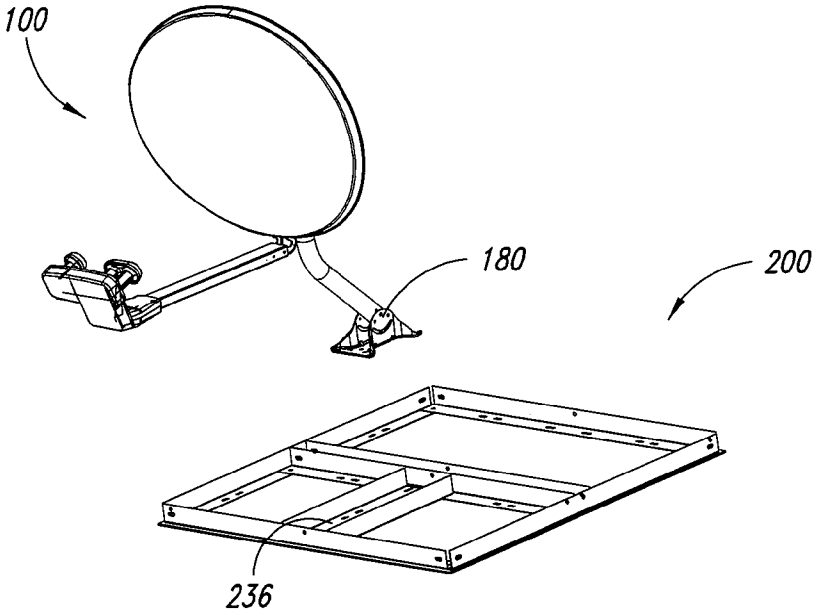

FIGS. 5A, 5B, and 6A-6C illustrate an assembly process for the non-penetrating antenna mounting system according to one embodiment of the present disclosure. FIGS. 5A and 5B show an antenna system 100 being mounted to a non-penetrating base 200. The antenna system 100 can be secured to the non-penetrating base 200 by any known method, such as by bolting the antenna system to the non-penetrating base 200. In this embodiment, the anchoring bracket 180 of the antenna system 100 is secured within the mounting area 236 of the non-penetrating base 200. Once the antenna system 100 is secured to the non-penetrating base 200, as shown in FIG. 5B, the non-penetrating base 200 can be loaded with ballast, such as cinderblocks, bricks, etc. The ballast is not depicted for ease of representation.

Figure 6B:
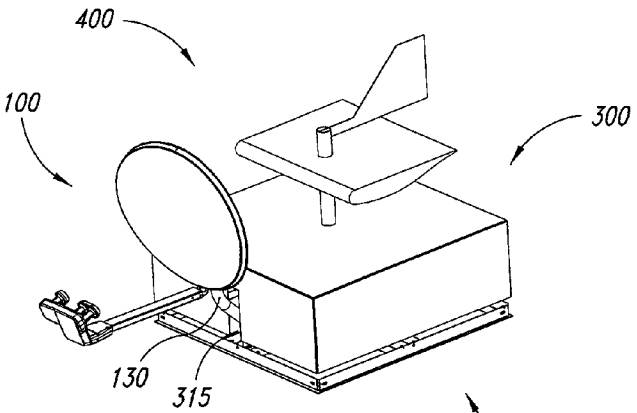
FIGS. 6A-6C illustrate an airfoil mounting assembly being mounted to the antenna system and the non-penetrating base shown in FIG. 5B.
Figure 6C:
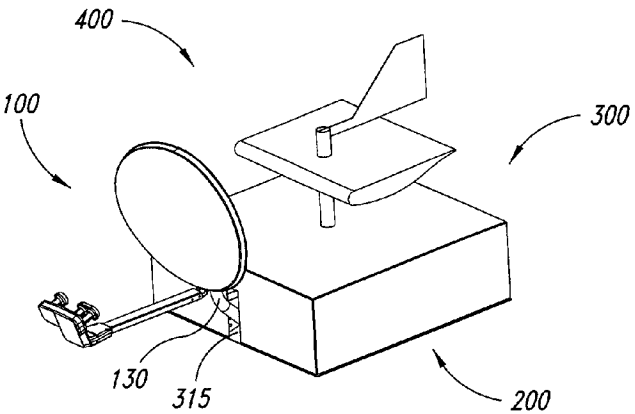
Figure 6A:
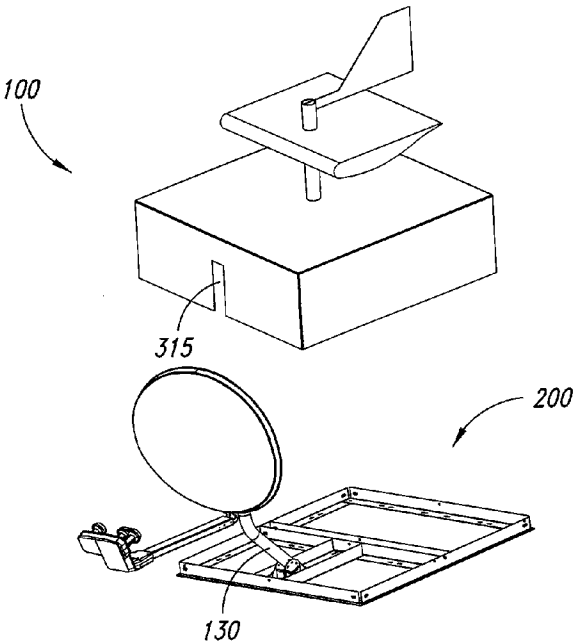

FIGS. 6A-6C show an airfoil mounting assembly 300 being mounted to the antenna system 100 and the non-penetrating base 200 shown in FIG. 5B. As shown in FIG. 6B, the mast 130 of the antenna system 100 extends beyond the non-penetrating base 200, such that only the anchoring bracket 180 and a bottom portion of the mast 130 are directly above the non-penetrating base 200. With this configuration, the airfoil mounting assembly 300 can be placed directly over the top of the ballast (not shown) and the non-penetrating base 200 such that the mast 130 extends though the opening 315 in the support structure 310, as shown in FIG. 6C. Thus, as best illustrated in FIGS. 1B and 6D, the antenna system 100 is positioned primarily outside of the support structure 310 of the airfoil mounting assembly 300. The airfoil mount assembly 300 can then be secured to the non-penetrating base 200 by bolts, screws, a latching mechanism, or any of a variety of mounting techniques that will be readily apparent to an individual of ordinary skill in the art.

III. Operation

FIGS. 7A-7D are views of a sequence of operation, according to one embodiment, of an example non-penetrating antenna mounting system when exposed to a change in wind direction.

Figure 7C:
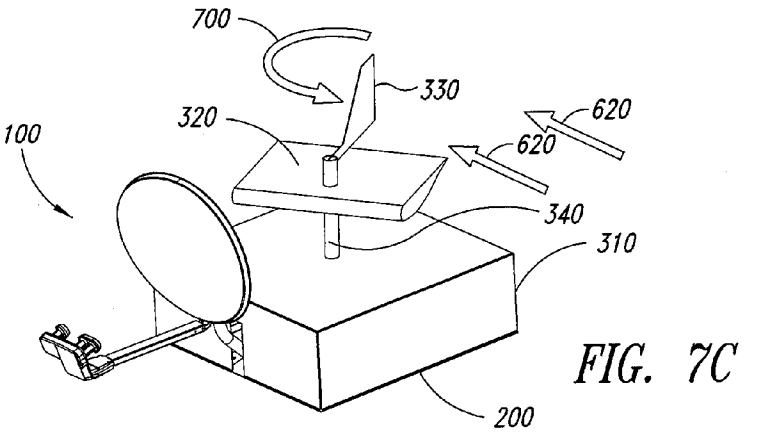
FIGS. 7A-7D are views of a sequence of operation, according to one embodiment of the present disclosure, of a non-penetrating antenna mounting system when exposed to a change in wind direction.
Figure 7D:
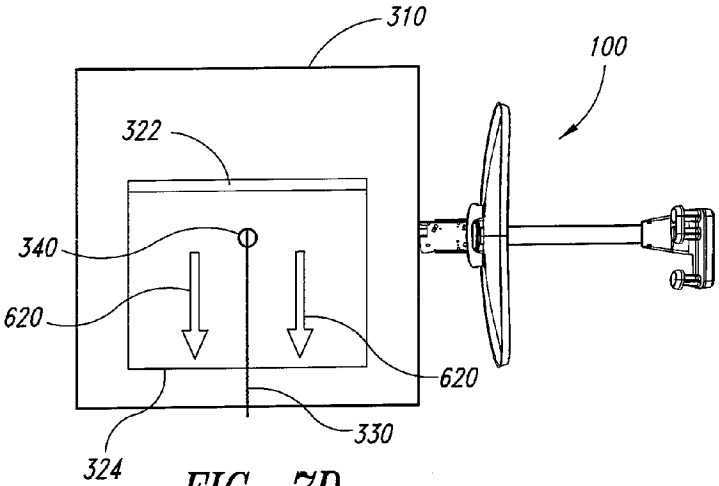
Figure 7A:
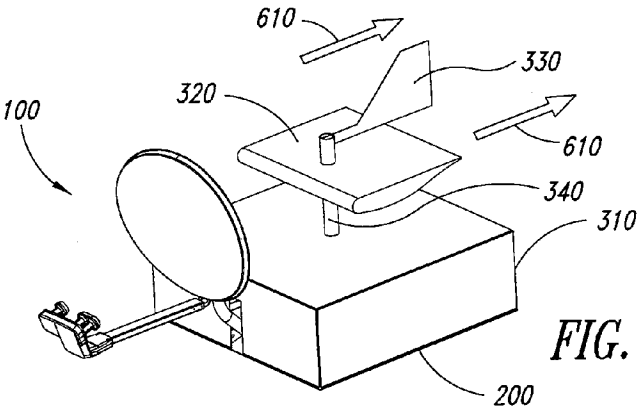
Figure 7B:
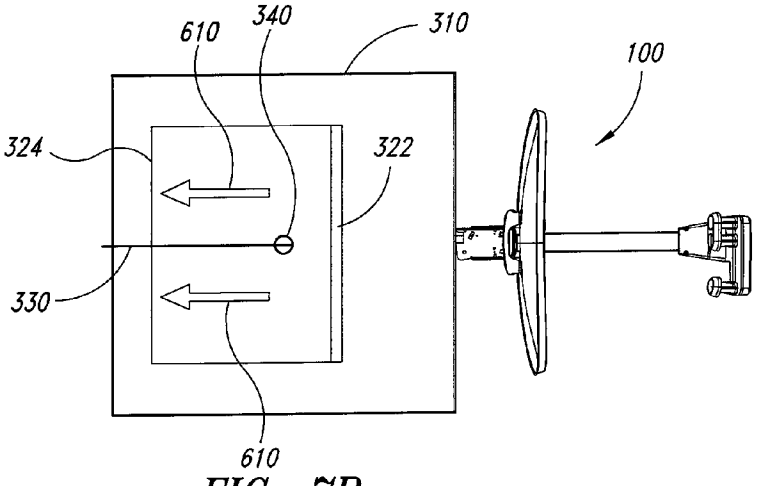

In FIGS. 7A and 7B, the non-penetrating antenna mounting system 400 is exposed to wind blowing in direction 610. In this state, the airfoil 320 is properly aligned with the wind direction such that wind passes over and under the airfoil 320 from the leading edge 322 to the trailing edge 324.

Figure 8:
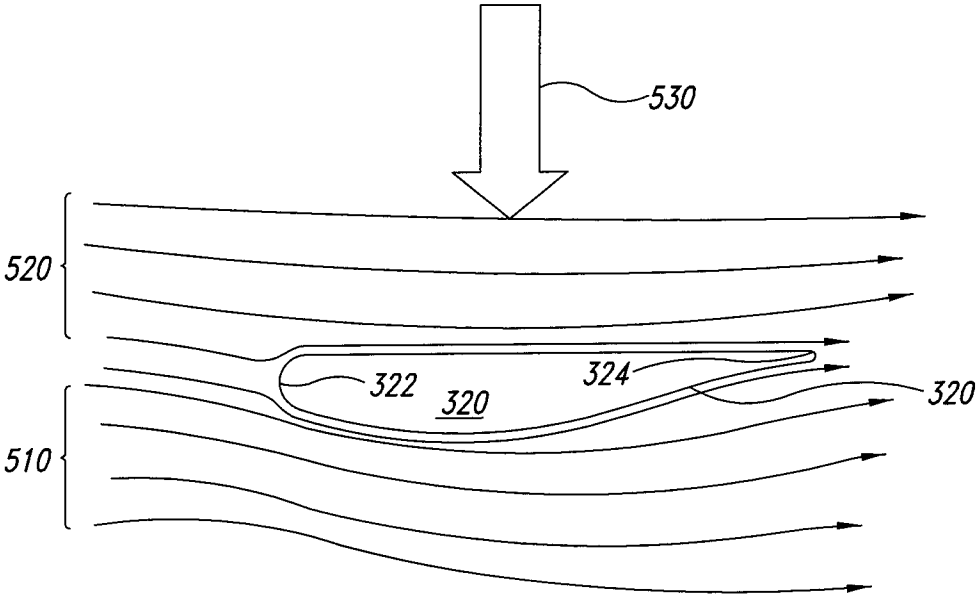
FIG. 8 is a schematic diagram of an airfoil of an example non-penetrating antenna mounting system during operation.

FIG. 8 illustrates the effects of wind passing over and under the airfoil 320 in this manner. In particular, lines 520 illustrate airflow lines above the airfoil 320, and lines 510 represent airflow lines below the airfoil 320. The airflow lines are for representative purposes only, and are not intended to limit the scope of the present invention. The shape and orientation of the airfoil 320 causes the air flowing under the airfoil 320 to move at a higher velocity than the air flowing above the airfoil 320. Using Bernoulli's principle, it can be shown that the differences in relative wind speeds above and below the airfoil 320 creates a region of higher pressure above the airfoil 320 relative to the region immediately below the airfoil 320. This pressure differential results in a downforce 530 acting on the airfoil 320. Thus, when the airfoil 320 is properly oriented, the downforce causes the non-penetrating antenna mounting system to be more securely anchored to the structure without requiring any additional ballast.

The shape of the airfoil 320 is not particularly limited to that shown in FIG. 8. The shape of the airfoil 320 can be any acceptable shape that achieves a desired downforce when exposed to wind. As will be readily apparent to one having ordinary skill in the art, the angle of attack of the airfoil 320 can be also different from that shown in FIG. 8, and still be within the scope of the present disclosure.

FIG. 7C illustrates a change in wind direction from the wind direction 610 illustrated in FIGS. 7A and 7B to the wind direction 620. Wind approaching from direction 620 acts on the tail portion 334 of the wind vane 330 and causes the airfoil 320, the wind vane 330, and the support shaft 340 to rotate relative to the support structure 310 as a unit. The rotation continues until, as shown in FIG. 7D, the airfoil 320 is properly aligned with the wind direction such that wind passes over and under the airfoil 320 from the leading edge 322 to the trailing edge 324, resulting in a downforce on the non-penetrating antenna mounting system. In this manner, the stability of the non-penetrating antenna mounting system can be improved regardless of the wind direction.

Unless the context requires otherwise, throughout the specification and claims which follow, the word "comprise" and variations thereof, such as "comprises" and "comprising," are to be construed in an open, inclusive sense, that is as "including, but not limited to."

It should be noted that, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

It will be appreciated that the illustrated embodiments can be located or oriented in a variety of desired positions, including various angles, sideways and even upside down. The antenna systems can be installed in a wide range of different locations and orientations. The non-penetrating antenna mounting system can be incorporated into a wide range of different types of roof-mounted fixtures. The location and orientation of the shaft, airfoil and support structure, as well as other components of the non-penetrating antenna mounting system, can be selected based design of the antenna.

Various methods and techniques described above provide a number of ways to carry out the invention. There is interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein, such as methods of installation, positioning, tuning, and the like, are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A non-penetrating antenna mounting system, comprising:

a frame configured to retain ballast to secure the frame to a surface of a structure without penetrating the surface of the structure;

an antenna mounted on the frame; and an airfoil mounted on the frame, the airfoil being oriented relative to the frame to impart a downforce on the frame when exposed to wind.

2. The non-penetrating antenna mounting system according to claim 1, wherein the airfoil is rotatably mounted on the frame.

3. The non-penetrating antenna mounting system according to claim 2, further comprising a wind vane mounted to the airfoil, the wind vane and the airfoil being configured to turn into the wind.

4. The non-penetrating antenna mounting system according to claim 2, further comprising:

a wind vane fixedly mounted on the airfoil, the airfoil and the wind vane being configured to swivel relative to the frame together as a unit in response to wind blowing in a wind direction to orient the airfoil with a leading edge of the airfoil upstream of a trailing edge of the airfoil with respect to the wind direction.

5. The non-penetrating antenna mounting system according to claim 1, wherein the airfoil is non-rotatably fixed to the frame.

6. The non-penetrating antenna mounting system according to claim 1, wherein the airfoil has a saucer shape, an upper surface of the airfoil being substantially flat, and a lower surface of the airfoil including a curve that is symmetrical with respect to a vertical axis of the airfoil.

7. The non-penetrating antenna mounting system according to claim 1, further comprising a shaft extending from the frame to the airfoil, the shaft being fixedly mounted to the frame so as to be non-rotatable relative to the frame.

8. The non-penetrating antenna mounting system according to claim 7, wherein the airfoil is rotatably mounted to the shaft so as to be rotatable relative to the shaft and the frame.

9. The non-penetrating antenna mounting system according to claim 1, further comprising a ballast cover mounted on the frame, the ballast cover extending over at least a portion of the antenna.

10. The non-penetrating antenna mounting system according to claim 9, further comprising:

a support shaft rotatably mounted on the ballast cover to rotate relative to the ballast cover; and a wind vane mounted on the support shaft, the wind vane and the airfoil being fixedly mounted on the support shaft, the airfoil, the wind vane, and the support shaft being configured to swivel relative to the ballast cover together as a unit in response to wind blowing in a wind direction to orient the airfoil with a leading edge of the airfoil upstream of a trailing edge of the airfoil with respect to the wind direction.

11. The non-penetrating antenna mounting system according to claim 9, wherein the ballast is entirely enclosed within the ballast cover.

12. The non-penetrating antenna mounting system according to claim 9, wherein the antenna is a satellite dish antenna that includes a mast that extends from a mounting portion fixedly secured to the frame within an interior of the ballast cover, through an opening in the ballast cover, to a satellite dish supported outside of the ballast cover.

13. An antenna mounting system, comprising:

a base;

an antenna mounted to the base;

an airfoil rotatably mounted to the base, the airfoil including a profile configured to impart a downward force to the base when the airfoil faces into a current wind direction; and a wind vane fixedly mounted to the airfoil, the wind vane being configured to rotate the wind vane and the airfoil into the current wind direction.

14. The antenna mount system according to claim 13, wherein the base is configured to receive ballast to secure the base to a surface of the structure without penetrating the structure.

15. The airfoil mount system according to claim 13, further comprising a support mounted to the base, the support being configured to distribute load from the airfoil to the base.

16. The airfoil mount system according to claim 15, further comprising a shaft rotatably mounted on the support to rotate relative to the support, the airfoil and the wind vane being fixedly mounted to the support shaft.

17. A method for securing an antenna to a structure without penetrating the structure, comprising:

mounting a base to an external surface of a structure without penetrating the surface of the structure;

mounting an antenna to the base; and arranging an airfoil on the base, the arranging the airfoil including orienting the airfoil so that the airfoil will be exposed to wind, orienting the airfoil so that the airfoil will impart a downward force on the base when facing into the wind, mounting a wind vane to the airfoil so that the wind vane is fixed relative to the airfoil, and mounting the airfoil and the wind vane to the base so that the wind vane to the airfoil are rotatable relative to the base, the wind vane driving rotation of the airfoil when exposed to the wind so that the airfoil and the wind vane face into the wind.

18. The method for securing an antenna to a structure without penetrating the structure of claim 17, wherein the mounting the base to the external surface of the structure includes adding ballast to the base.

19. The method for securing an antenna to a structure without penetrating the structure of claim 18, further comprising mounting a cover to the base to enclose the ballast.

20. The method for securing an antenna to a structure without penetrating the structure of claim 19, wherein mounting the airfoil and the wind vane to the base includes mounting the airfoil and the wind vane to the cover.

* * * * *